US006014827A

United States Patent [19]

Lehrman

[11] Patent Number: 6,014,827

[45] Date of Patent: Jan. 18, 2000

[54] IRONING BOARD WITH LAUNDRY SORTER AND DRYING RACK

[76] Inventor: David Lehrman, 207 Barclay Cir., Cheltenham, Pa. 19102

[21] Appl. No.: 09/004,139

[22] Filed: Jan. 7, 1998

[51] Int. Cl.[7] ..... D06F 81/04

[52] U.S. Cl. ..... 38/104; 38/106; 38/111; 38/137; 38/DIG. 2; 38/DIG. 3

[58] Field of Search ..... 38/103, 104, 106, 38/111, 135, 137, 112; D32/37; 220/9.3

[56] References Cited

U.S. PATENT DOCUMENTS

| | | | |
|---|---|---|---|
| D. 213,131 | 1/1969 | Hamilton | D32/37 |
| 1,563,476 | 12/1925 | Faris | 38/111 |
| 2,165,426 | 7/1939 | Tuttle et al. . | |
| 2,473,351 | 6/1949 | Thompson et al. . | |
| 2,637,918 | 5/1953 | Mayhew | 38/111 |
| 2,638,399 | 5/1953 | Seymour | 220/9.3 |
| 2,661,554 | 12/1953 | Siczkiewicz, Jr. et al. . | |
| 2,754,603 | 7/1956 | Williams | 38/106 |
| 2,771,261 | 11/1956 | Niggeloh . | |
| 2,908,984 | 10/1959 | Lantz . | |
| 2,912,202 | 11/1959 | Petrick . | |
| 3,268,194 | 8/1966 | Nielsen . | |
| 3,338,539 | 8/1967 | Foster . | |
| 3,855,946 | 12/1974 | Bales . | |
| 4,910,896 | 3/1990 | Ruschitzka | 38/139 |
| 4,970,968 | 11/1990 | Mattesky . | |
| 5,281,063 | 1/1994 | Austin, III . | |
| 5,685,237 | 11/1997 | Lehrman . | |

FOREIGN PATENT DOCUMENTS

| | | | |
|---|---|---|---|
| 256911 | 9/1962 | Australia | 38/103 |
| 930073 | 1/1948 | France . | |
| 1213226 | 3/1960 | France . | |
| 186604 | 8/1956 | Germany | 38/111 |
| 1801159 | 4/1970 | Germany . | |

OTHER PUBLICATIONS

Photocopy of brochure "Ironees® Ironing Tables", 1 page identified as PR3446, The Ironees Company.

*Primary Examiner*—Ismael Izaguirre
*Attorney, Agent, or Firm*—Akin, Gump, Strauss, Hauer & Feld, L.L.P.

[57] ABSTRACT

An ironing board having a table with a top surface to carry out ironing functions and opposing first and second sides bisected by a longitudinal axis and a frame extending form the table for supporting the table above a support surface is provided. The frame extends from the table between the first side and longitudinal axis and defines an open area beneath the table that is sized to receive a person seated in a chair to permit the person to carry out ironing functions on the top surface while sitting. The ironing board also includes a drying rack having a plurality of rungs slidably disposed on the table. A laundry sorter is suspended from the table and includes a receptacle with a plurality of dividers dividing the receptacle into a plurality of compartments.

24 Claims, 6 Drawing Sheets

IRONING BOARD WITH LAUNDRY SORTER AND DRYING RACK

BACKGROUND OF THE INVENTION

The present invention relates to an ironing board and, more particularly, to an ironing board having in combination, a frame that allows a person to sit comfortably while ironing, a drying rack and/or a clothes sorter.

Ironing boards are well known. They are used in virtually every household and are also present in commercial laundry rooms as well as dry cleaning facilities. The table or surface of the ironing board is used as the platform on which a multitude of clothing, linens, and other wrinkled textiles are pressed or ironed.

The conventional ironing board includes a table having a smooth top surface and a frame from which the table is supported. The frame supports the table above a support surface which is typically the floor and is generally designed so the there are a series of positions to which the table may be extended. An average ironing board provides for a lowest position just above the ground and extends to a maximum height of about 3½ feet (106.7 cm) above the ground. The frames are located at a central position on the lower surface of the table so that the overall table is balanced when the article to be ironed is on the table and possible pressure is exerted by the person ironing is also applied to the table. The frames generally consist of two legs that are crossed to form an X in elevational view when fully extended and come together when closed to a storage position. Unfortunately because the frame is centered under the table and is so cumbersome when extended to any of the heights, the person carrying out the ironing functions is generally limited to standing adjacent the ironing board. Certainly, such a situation precludes the person ironing from pulling up a chair and sitting comfortably so that the person's lap and legs are under the table portion of the ironing board.

Furthermore, the conventional ironing board provides no accessories to facilitate the person in performing any additional laundry functions. As an example, for washed articles that must be drip dried (i.e., not dried in a dryer), the person doing the laundry must find and set up a separate drying rack or system for these items. This is particularly inconvenient for most people and is particularly so for those living in a small apartment or those having a small laundry room. In addition, for people ironing shirts or other articles that must be hung by a hanger after the article is ironed, they must once again seek out an additional rack or hanger support so that the article may be hung and not once again wrinkled. Here again, for people living in small living spaces, these additional racks and hanging areas are an unwelcome sight.

In addition, ironing boards typically fail to provide any other features to facilitate the laundry steps. For example, the person doing laundry typically must sort the articles to be washed prior to washing. Examples of this include separating all whites so that they are washed together and not discolored by any bleeding of colors from colored articles. In addition, with the variety of materials used in making garments and other washable items, the garments must also be sorted based on the temperature of water and type of detergent to be used. Finally, many people, particularly infants, require a milder type of detergent used in cleaning their clothes to prevent skin allergies. Here again, these clothing articles must be sorted and separated from other items to be laundered. Generally, the person doing the laundry simply sorts by piling the clothes and other articles onto the floor or into boxes on the floor where they get even dirtier than they originally were. For older or handicapped people, this becomes a major burden as they must bend down to reach the articles and then lift them to put them into the washer. The use of an independent stand-up sorter is also problematic where floor space is at a premium. Even though the ironing board is a predominant and bulky structure in the laundry room which occupies a significant amount of space, no sorter has heretofore been provided with an ironing board to facilitate these operations.

Therefore, there is a need for an ironing board to have features that better facilitate the various laundering operations of clothing and other articles. Specifically there is a need for an ironing board to have a construction to allow someone to be able to sit comfortably next to an ironing board so that their lap and legs are unencumbered and still enable the person ironing to have full range of their ironing faculties. In addition, there is a need for an ironing board to be provided with a drying rack and also one to be provided with a sorter. Finally, there is a need for an ironing board to have a combination of the abovementioned features.

BRIEF SUMMARY OF THE INVENTION

In a first aspect, the present invention is an ironing board having a table with a top surface to carry out ironing functions and in which the table has opposing first and second sides bisected by a longitudinal axis. The ironing board also has a frame extending from the table for supporting the table. The frame extends from the table between the first side and the longitudinal axis thereby defining an open area beneath the table. The open area is sized to receive a person seated in a chair and permits the person to carry out ironing functions on the top surface of the table while seated in the chair.

In a second aspect, the present invention is an ironing board having a table with a top surface to carry out ironing functions and a frame extending from the table for supporting the table above a support surface. The ironing board is also provided with a drying rack. The drying rack has a plurality of rungs and is slidably disposed on the table.

In a third aspect, the present invention is an ironing board having a table with a top surface to carry out ironing functions and a frame which extends from the table and supports the table above a support surface. A laundry sorter is suspended from the table. The sorter includes a receptacle with a plurality of dividers dividing the receptacle into a plurality of compartments.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
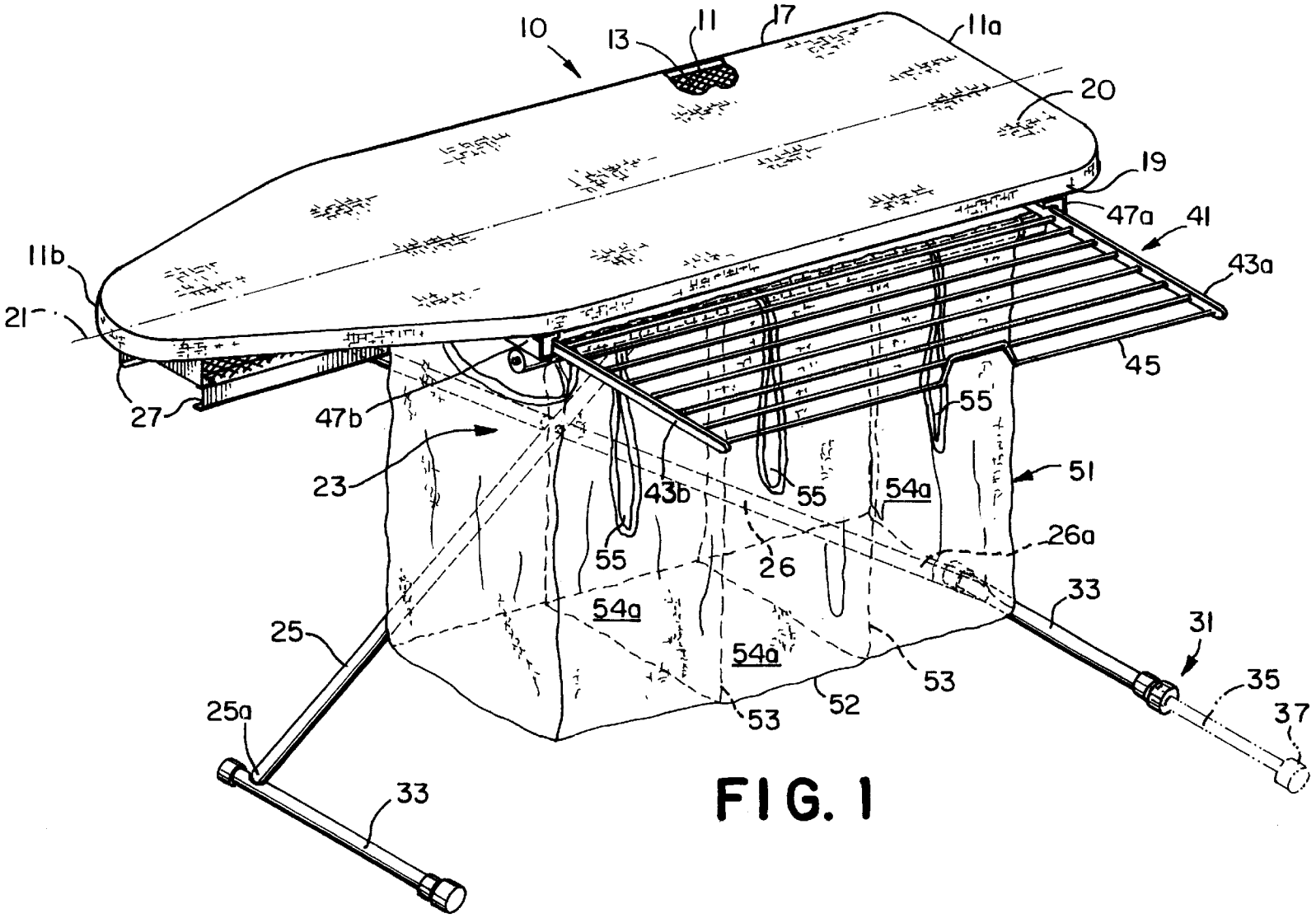
FIG. 1 is a perspective view, partially broken away, of an ironing board according to the present invention.

Certain terminology is used in the following description for convenience only and is not limiting. The words, "right," "left," "lower," and "upper," designate directions in the drawings to which reference is made. The words "inwardly" and "outwardly" refer to directions toward and away from, respectively, the geometric center of the ironing board and designated parts thereof. The terminology includes the words above specifically mentioned, derivatives thereof and words of similar import.

Referring now to the drawings in detail, wherein like numerals are used to indicate like elements throughout, there is shown in FIGS. 1–10, a preferred embodiment of the ironing board, generally designated 10, in accordance with the present invention. Referring now to FIGS. 1–4, the ironing board 10 has a table 11 with a top surface 13, a bottom surface 15, and first and second side surfaces 17 and 19. The first and second side surfaces are bisected by a longitudinal axis 21 of the table 11 (shown by the dashed line). The table 1 is preferably a conventional 54" (137.2 cm) by 15" (38.1 cm) ironing table that is made of a strong durable metallic material, such as aluminum. However, it is understood by those of ordinary skill in the art that the present invention is not limited to constructing the table 11 of any particular material and that other materials, such as wood or high temperature polymeric materials, could be used without departing from the spirit and scope of the invention. Unless otherwise mentioned, all of the elements of the ironing board 10 are constructed of the same material as the table 11.

The table 11 includes a wide ironing area which extends from the heel or non-tapered end 11*a* of the ironing board 10 to a location along the length of the table 10 where the first and second sides 17 and 19 are generally parallel. The ironing table is then preferably tapered to an end or nose 11*b* having approximately a width of 5" (12.7 cm). The table 11 is of a web construction to form a plurality of perforations uniformly spread across the surface of the table 11 to help reduce the overall weight of the ironing board 10. It is understood by those of ordinary skill in the art from this disclosure that the present invention is not limited to any particular structure or shape. For instance, the table 11 could be constructed of a solid material (i.e., no web), without departing from the spirit and scope of the invention. A pad/cover 20 is provided on the top surface 13 of the table 11 in a manner well understood by those of ordinary skill in the art.

Figures 2, 8:
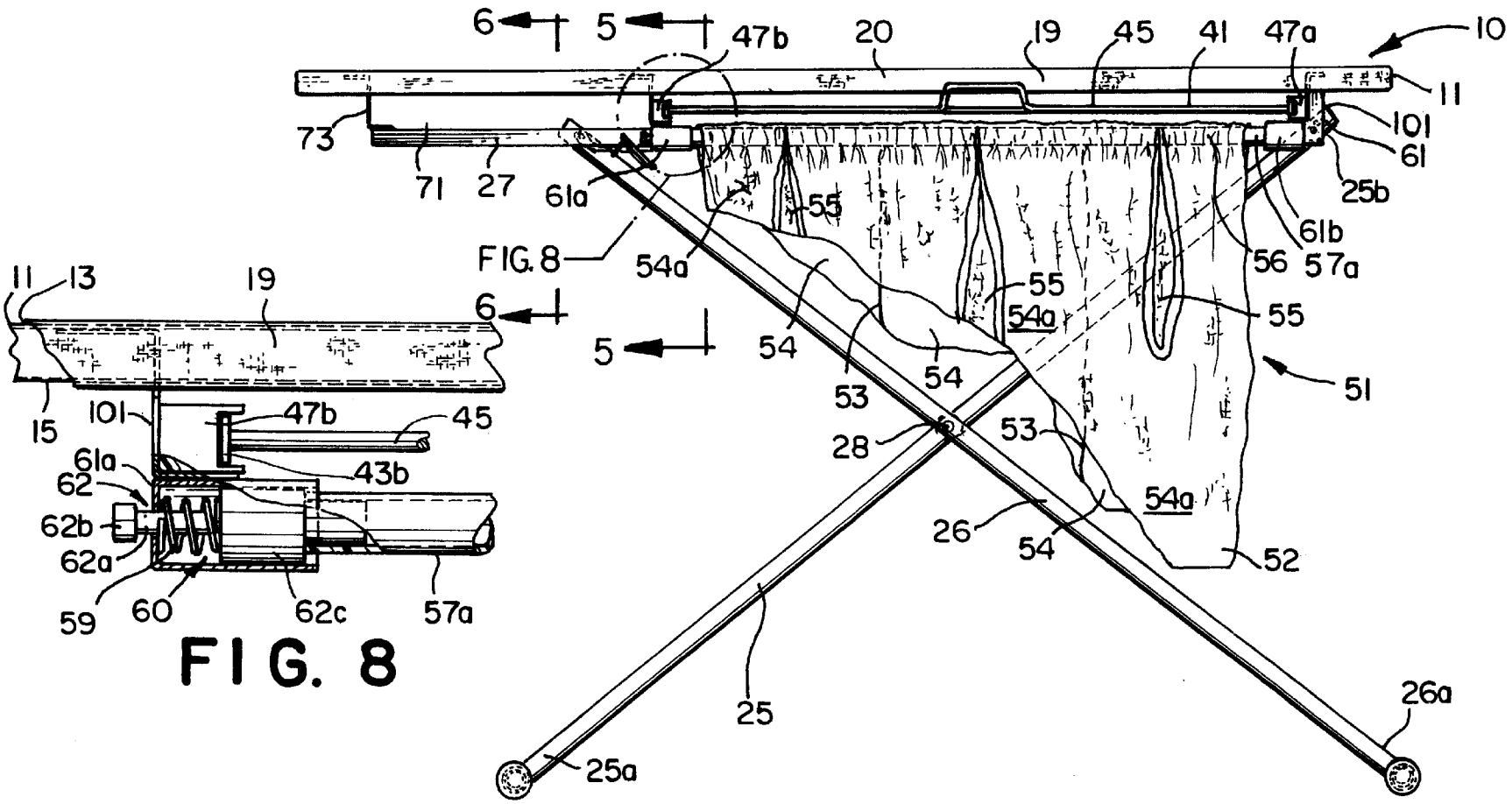
FIG. 2 is a right side elevational view of the ironing board shown in FIG. 1.
FIG. 8 is a greatly enlarged fragmentary view of a portion of the ironing board shown in FIG. 2.
Figure 3:
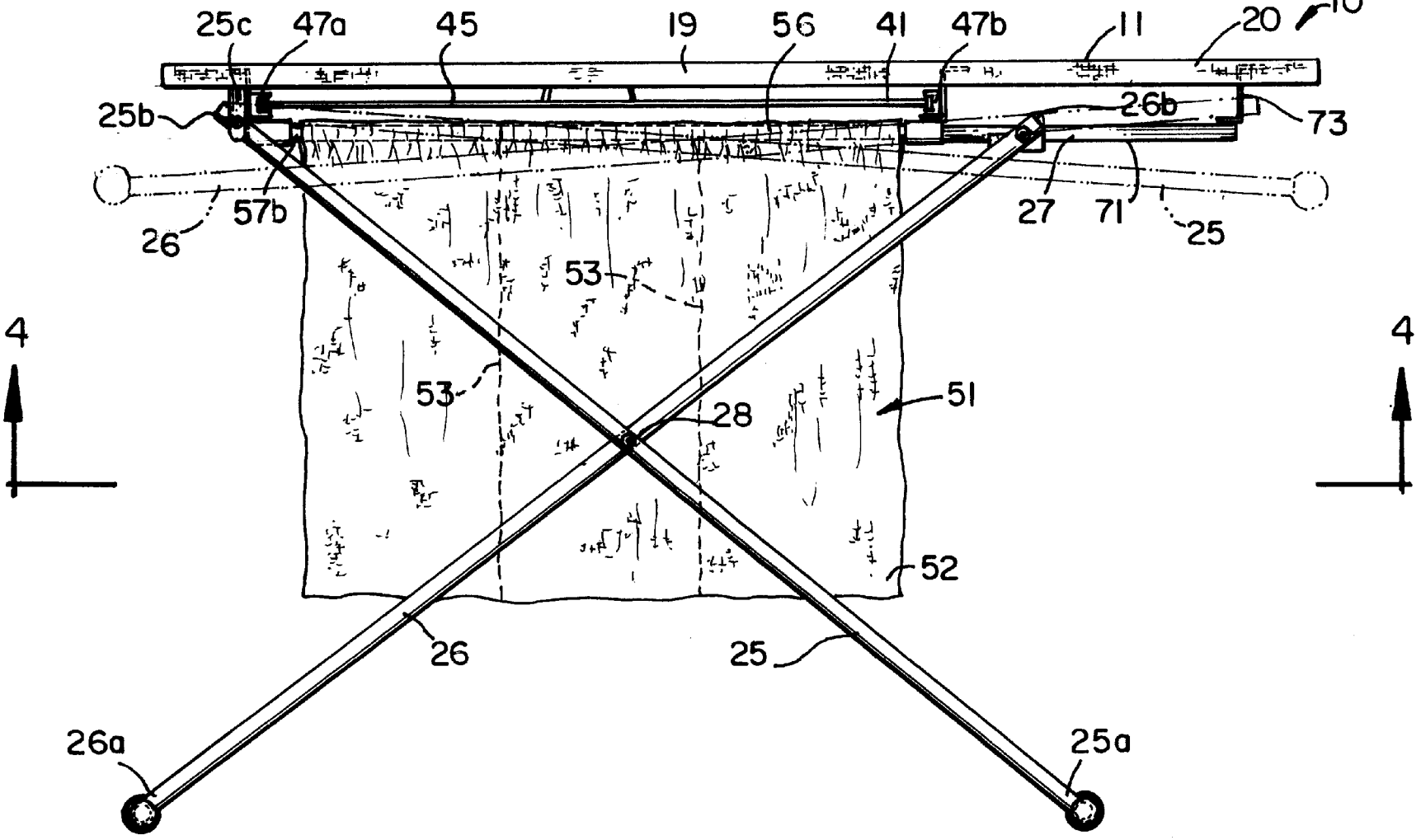
FIG. 3 is a left side elevational view of the ironing board shown in FIG. 1.
Figure 4:
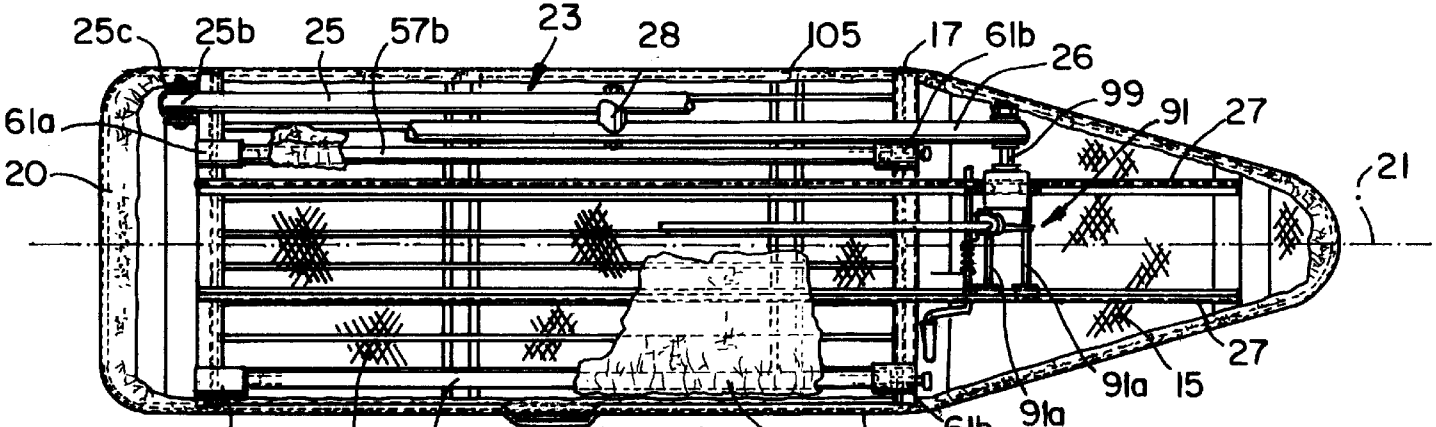
FIG. 4 is a cross-sectional view, partially broken away, of the ironing board shown in FIG. 3 taken along line 4—4 of FIG. 3.
Figure 9:
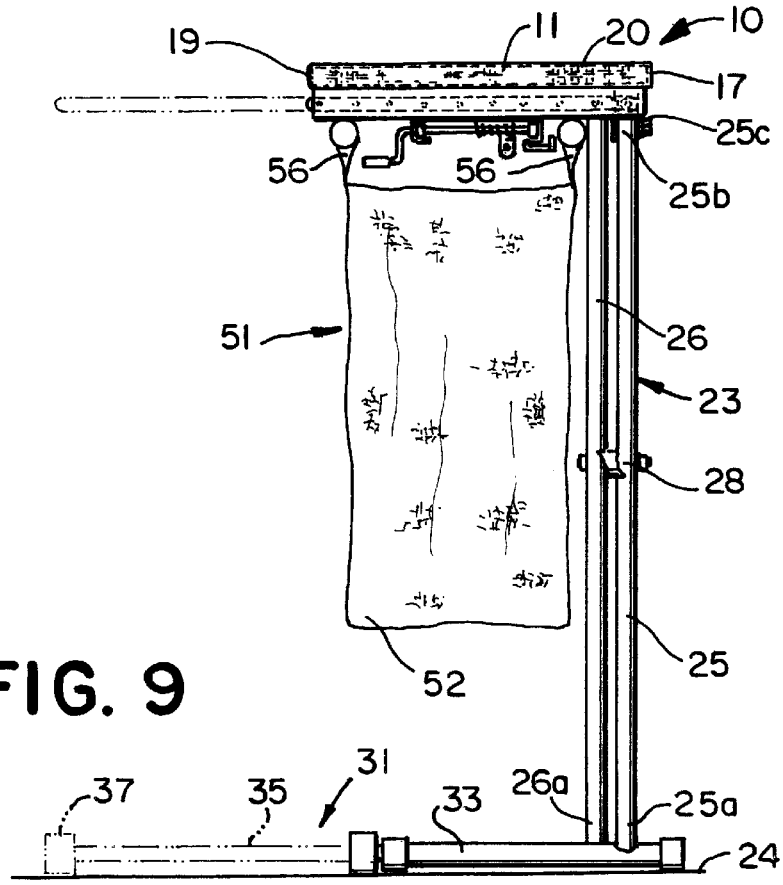
FIG. 9 is a rear elevational view of the ironing board shown in FIG. 1.
Figure 10:
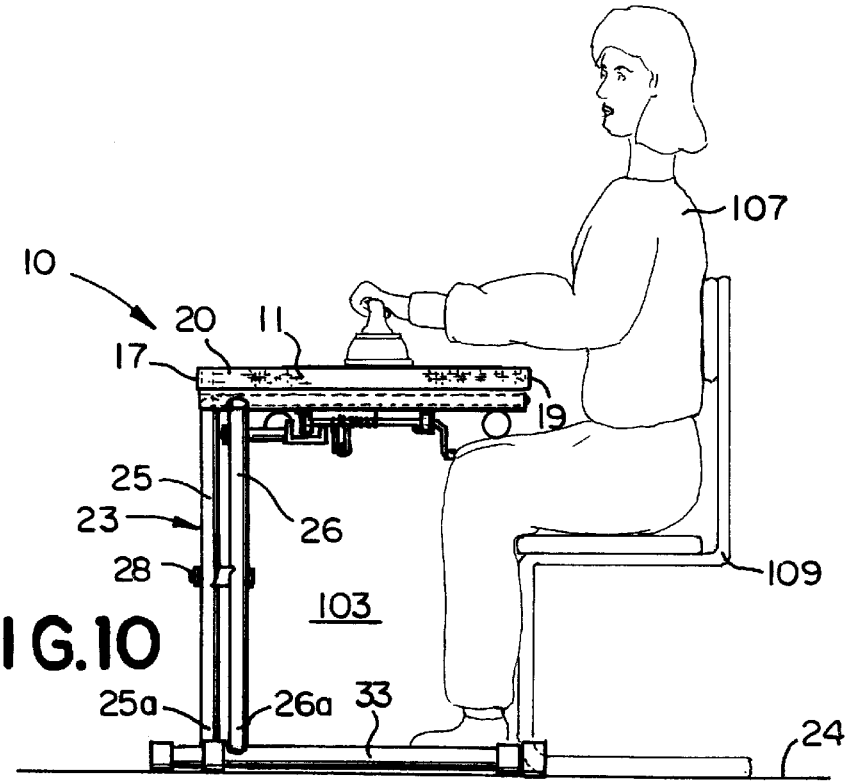
FIG. 10 is a front elevational view showing a person ironing on the ironing board shown in FIG. 1.

Referring to FIGS. 1–4 and 9–10, a frame 23 is shown that extends from the table 11 and supports it above a support surface or ground 24. The frame 23 includes substantially straight first and second legs 25, 26 respectively, that are crossed generally in the shape of an X in elevational view when fully extended. In the preferred embodiment, the first and second legs 25, 26 extend from the bottom surface 15 of the table 11 to the support surface 24. The terminal end 25*a*, 26*a* of the first and second legs 25, 26 includes a foot 33 extending transversely with respect to the longitudinal axis 21 which engages the support surface 24. As shown in FIGS. 2–4, a proximal end 25*b* of the first leg 25 is pivotally secured to the table 11 at its bottom surface 15 proximate the heel 11*a* of the table 11. The proximal end 25*b* of the first leg 25 is pivotally secured to the table 11 with a pin and frame assembly 25*c* well understood by those of ordinary skill in the art. The legs 25 are preferably secured to each other by a conventional pintle mechanism 28 which permits the legs 25 to pivot with respect to each other and allow the frame 23 to be infinitely adjustable between fully extended position (as shown in FIGS. 14 and 9–10) and a storage position (shown in phantom in FIG. 3), as described in more detail hereinafter.

Referring now to FIGS. 4–7, the frame 23 also includes two operational generally U-shaped tracks 27 which extend generally parallel to each other and are attached to the bottom surface 15 of the table 11. The tracks 27 face each other and straddle the longitudinal axis 21 that bisects the table 11. The tracks 27 are preferably attached to the bottom surface 15 by welding via suitable brackets 73 (only one is shown clearly) which space the tracks 27 from the bottom surface 15. However, the tracks 27 may be attached by other means such as gluing, stapling, or nailing in place. It is understood by those of ordinary skill in the art from this disclosure that the present invention in not limited to any particular type of method of attaching the tracks 27 to the table 11.

Referring to FIG. 4–7, the frame 23 preferably includes a channel coupling 91 slidably disposed between the tracks 27. The coupling 91 includes a pair of generally parallel adjacent rods 91*a*. Each rod 91*a* includes a polymeric bushing 91*b* on each end thereof. The bushings 91*a* are slidably disposed within each track 27 to permit the rods 91*a* to slide with respect to the tracks 27. A generally U-shaped bracket 91*c* extends from each rod 91 a toward the proximal end 26*b* of the second leg 26. The U-shaped bracket 91*c* maintains the rods 91*a* in the spaced apart relationship. An extended dowel 99 extends from the U-shaped bracket 91*c* and is in pivotal engagement with the proximal end 26*b* of the second leg 26 to allow the proximal end 26*b* of the second leg 26 to pivot with respect to the dowel 99 as the frame 23 moves between the fully extended position and the storage position.

A control bar 93 is pivotally secured to the rod 91*a* closest the nose 11*b* of the table 11. The control bar 93 extends longitudinally toward the heel 11*a* of the table 11. A conventional adjustment mechanism 94 infinitely controls the position of the coupling 91 with respect to the tracks 27 to thereby control the position of the frame 23. The adjustment mechanism 94 includes a rotatable handle 97 that extends through both tracks 27 generally transverse to the longitudinal axis 21. A coil spring 95 is positioned around the handle 97 between the tracks 27. One end of the coil spring 95 is held against a plate 27*a* which extends across the top of the tracks 27 and the other end biases a friction latch 96 downwardly. The friction latch 96 is rotatably secured to the handle 97 by a suitable fastener, such as screw 96*c*, and includes a complementary through hole slidably receiving the control bar 93. In the biased position, the spring 95 locks the control bar 93, and thus the frame 23, in position. When the handle 97 is rotated against the bias of the spring 95, clearance is provided between the through hole in the latch 96 and the control bar 93, to allow the proximal end 26*a* of the second leg 26 to move with respect to the table 11 and thereby adjust the position of the frame 23, in a conventional manner well understood by those of ordinary skill in the art.

Referring to FIGS. 4, 5, 7 and 10, unlike conventional ironing boards, the first and second legs 25, 26 of the ironing board 10 are offset from the longitudinal axis 21 by the dowel 99. Thus, the frame 23 exclusively extends from the table 11 between the first side 17 and the longitudinal axis 21 to define an open area 103 beneath the table 11. The location of the legs 25 in such an offset manner results in an open area 103 beneath the table 11 to receive a person 107 seated in a chair 109. The open area 103 is sufficiently sized so that the person's legs and lap are under the table 11 and are not encumbered by the frame 23. The person 107 can adjust the height of the table 11 and then sit comfortably with their lap and legs under the table 11 and carry out all the ironing functions. The person 107 seated in the chair 109 is capable of carrying out all ironing functions as could be performed in a standing position but is able to perform them more comfortably. Accordingly, the frame 23 is infinitely adjustable between the fully extended position and the storage position to allow a person to carry out ironing functions on the top surface 13 of the table 11, either standing or sitting in a chair.

It is understood by those of ordinary skill in the art from this disclosure, that the particular type of frame 23 and the manner in which it is mounted to the table 11 is not pertinent to the present invention so long as the open area 103 is defined beneath the table 11. For instance, the tracks 27 may be positioned and attached to the table 11 in a manner that does not straddle the longitudinal axis 21, but rather is located at a position that is between the first side 17 of the table 11 and the longitudinal axis 21 (not shown). In such an embodiment, the extended dowel 99 would not be necessary.

Referring now to FIGS. 1, 9, and 10, the ironing board 10 includes a counterbalance extension section 31 to maintain the ironing board 10 in an upright position when forces are applied to the second side 19 of the table 11, such as by use of the drying rack 41, described hereinafter. The counterbalance extension section 31 extends from the lower portion of the frame 23 across the longitudinal axis 21 of the table 11 toward the second side 19 of the table 11. A preferable construction of the counterbalance extension section 31 includes a pair of telescoping feet 35 projecting from the frame 23. More particularly, each of the feet 33 mounted on the terminal ends 25*a*, 26*a* of the first and second legs 25, 26 telescopically receives one of the telescoping feet 35 such the telescoping feet 35 are extendible to varying degrees based on need and the preferences of the user. A conventional rotatable friction locking mechanism (not shown) is mounted on the end of the telescoping feet 35 within the feet 33 mounted on the terminal ends 25*a*, 26*a* of the first and second legs 25, 26 such that rotation of the telescoping feet 35 with respect to the feet 33 on the first and second legs 25, 26 fixes the telescoping feet 35 in an axial position. An enlarged knob 37 is located at the distal end of telescoping feet 35 to tilt the top surface of the table 13 with respect to the support surface 24. The enlarged knob 37 is preferably constructed of a polymeric material, such as nylon.

When the telescoping feet 35 are in the extended position shown in phantom in FIGS. 1 and 9, forces applied to the second side 19 of the table 11 are counterbalanced and the table 11 maintains its upright position. Such forces typically occur when ironing functions are carried out adjacent the second side 19 of the table 11 or when the drying rack 41 is in the extended position shown in FIG. 1, as described in more detail hereinafter.

Referring to FIG. 1, another aspect of the ironing board 10 includes the provision of a drying rack 41 disposed therein. The drying rack 41 is provided so that washable items (not shown) that are not to be dried in a dryer may be hung thereon. Although the drying rack 41 is shown on the ironing board 10 having the frame 23 offset from the longitudinal axis 21 of the table 11, the drying rack 41 is also suitable on a conventional ironing board (not shown) wherein the frame 23 is positioned along the longitudinal axis 21 of the table 11. Depending on the size of the drying rack 41 (i.e., the number of rungs 45), the frame 23 may be provided with the counterbalance extension section 31 to prevent the ironing board 10 from tipping over when the drying rack 41 is in use.

The drying rack 41 as shown in FIG. 1 includes two (first and second) side members 43*a*, 43*b* having a plurality of rungs 45 disposed between them. Preferably the first and second side members 43*a*, 43*b* extend generally parallel to each other and the rungs 45 between them are likewise generally parallel to each other and are generally orthogonal to the first and second side members 43*a*, 43*b*. In the preferred embodiment, the drying rack 41 is slidably disposed on the ironing board 10 so that it may be extended from the table 11 in the form of a cantilever beam when in use and stowed under the table 11 when not being used.

Figure 5:
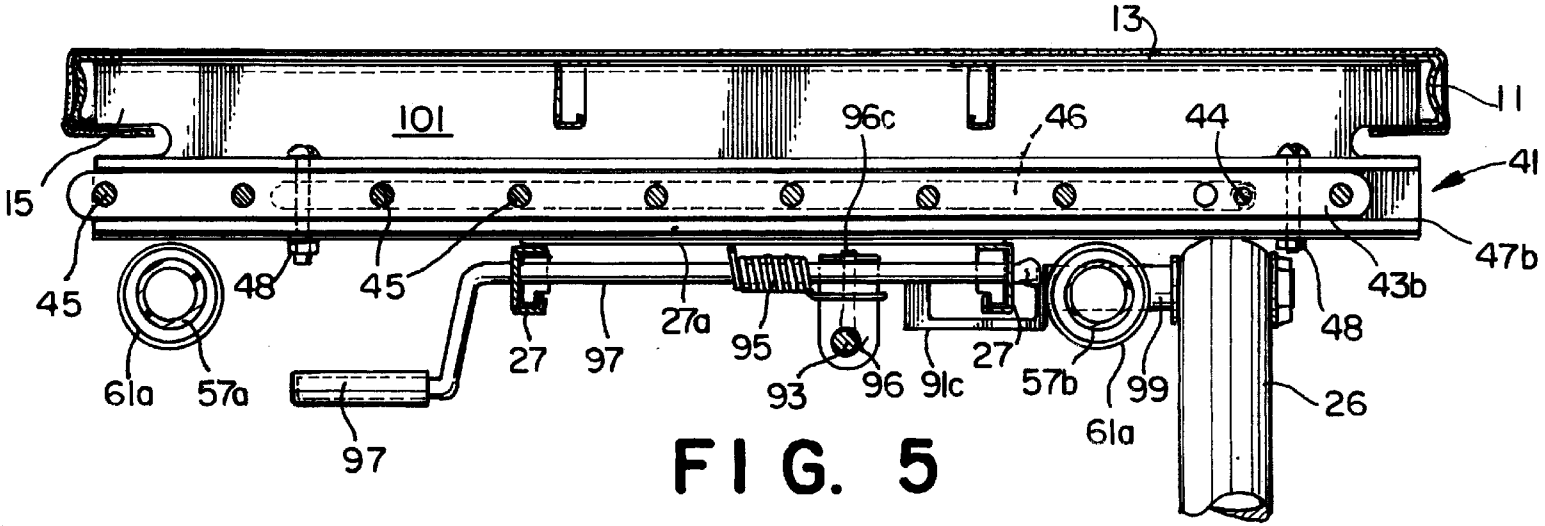
FIG. 5 is an enlarged cross-sectional view of the ironing board shown in FIG. 2 taken along line 5—5 of FIG. 2.
Figure 6:
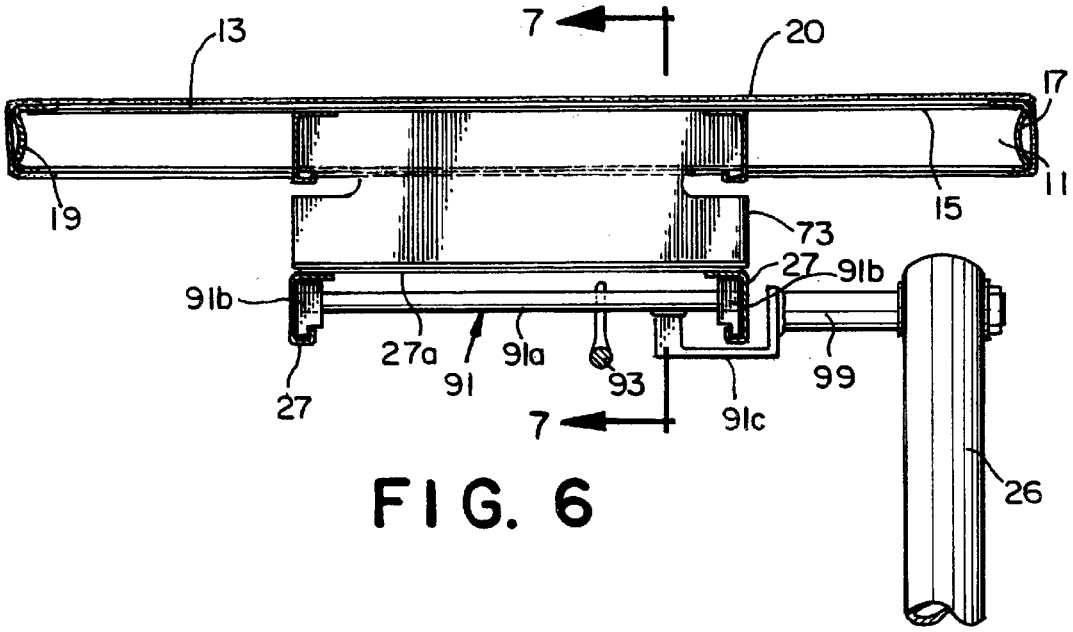
FIG. 6 is an enlarged cross-sectional view of the ironing board shown in FIG. 2 taken along line 6—6 of FIG. 2.
Figure 7:
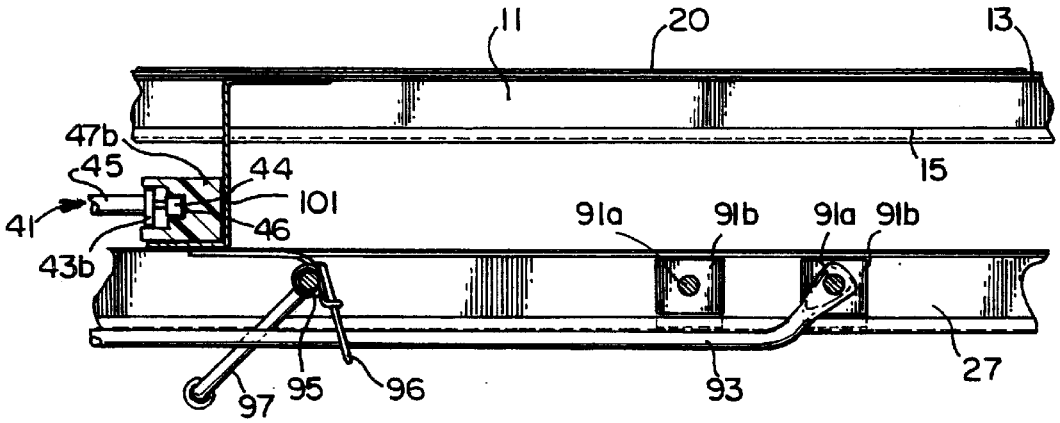
FIG. 7 is a cross-sectional view of the ironing board shown in FIG. 6 taken along line 7—7 of FIG. 6

Referring now to FIGS. 5, 7, and 8, first and second spaced apart generally U-shaped in cross section channels 47*a*, 47*b* are secured to the ironing board 10 and slidably receive the first and second side members 43*a*, 43*b*, respectively. The first and second channels 47*a*, 47*b* are preferably secured to mounting brackets 101 that extend from the bottom surface 15 of the table 11, as can be seen in FIG. 7. A pin 44 extends outwardly from the first and second side members 43*a*, 43*b* into sliding engagement with an inwardly facing complementary slot 46 formed on the first and second channels 47*a*, 47*b*, respectively. The pin 44 and slot 46 combine to limit the sliding motion of the drying rack 41 between the stowed position (see FIG. 9) and the use position (see FIGS. 1 and 9). The mounting brackets 101 and first and second channels 47*a*, 47*b* are positioned from the bottom surface 15 of the table 11, as shown in FIGS. 2 and 3, in such a location that they do not interfere with the track 27 that controls the height adjustment of the ironing board 10. In addition, the first and second channels 47*a*, 47*b* are positioned at a level where the drying rack 41 is free of interference with other parts of the ironing board 10 both when it is stowed and when it is use.

The first and second channels 47*a*, 47*b* are preferably constructed of a polymeric material with a low friction coefficient with respect to the material that is used to construct the drying rack 41. In the preferred embodiment the polymeric material is nylon, but other polymeric materials could be used without departing from the spirit and scope of the invention.

The mounting bracket 101 is preferably secured to the bottom surface 15 of the table 11 by welding and the first and second channels 47*a*, 47*b* are preferably secured to the mounting bracket 101 by suitable fasteners, such as nuts and bolts 48. However, it is understood by those of ordinary skill in the art that the first and second channels 47*a*, 47*b* could be secured to the table 11 in other manners without departing from the spirit and scope of the invention. For instance, the mounting bracket 101 could be omitted and the first and second channels 47*a*, 47*b* could be secured directly to the table 11. It is also understood by those of ordinary skill in the art that the present invention is not limited to any particular number of rungs 45. While the preferred embodiment discloses the use of ten rungs (see FIG. 5), only eight extend beyond the second side wall 19 of the table because of the position of the slot 46 and pin 44.

Referring now to FIGS. 1–3, the ironing board 10 may be further provided with a laundry sorter, generally designated 51, that is suspended from a surface of the table 11. The sorter 51 includes a receptacle 52 with a plurality of dividers 53 (shown in phantom) dividing the receptacle 52 into a plurality of compartments 54. Articles (not shown) of the same color or type fabric may be placed in the compartments 54. In the preferred embodiment, each of the compartments 54 has a front face 54*a* with a slit 55 therein so that the compartment 54 is accessible and articles to be washed can be placed therein. In the preferred embodiment, the sorter 51 is generally in the form of a parallelepiped and has two dividers 53, thereby dividing the receptacle 52 into three compartments 54. However, it is understood by those of ordinary skill in the art from this disclosure that the sorter 51 is not limited to any particular shape and that it can be divided into any number of compartments 54, without departing from the spirit and scope of the invention. The laundry sorter 51 is preferably constructed of a flexible fabric, woven or non-woven, and may include such fabrics as cotton, polyester, and other synthetic materials and blends to allow the sorter 51 to be readily laundered, as needed.

Referring now to FIGS. 2, 4, 5, and 8, the laundry sorter 51 is suspended or hung from the table 11 by a first rod 57*a* which is releasably mounted on the table 11. More particularly, first and second rods 57*a*, 57*b* are releasably mounted on opposite sides of the table 11 and are inserted within the upper hem 56 of the sorter 51 on the longitudinal sides thereof. The first and second rods 57*a*, 57*b* are releasably mounted to the table 11 to permit the sorter 51 to be removed. Once the first and second rods 57*a*, 57*b* are removed from the table 11, they can be slipped from the hem 56 to permit the sorter 51 to be laundered or to be carried to another location for laundry work.

Referring now to FIG. 8, the following description of the mounting of the first rod 57*a* is equally applicable to the mounting of the second rod 57*b*. First and second generally cylindrical clamps 61*a*, 61*b* are mounted beneath the table 11 for receiving the opposing ends of the first rod 57*a*. The inner facing surfaces of the first and second clamps 61*a*, 61*b* are positioned a distance which is less than the overall length of the first rod 57*a*. The first clamp 61*a* includes a biasing mechanism 60 which bias the first rod 57*a* toward the second clamp 61*b*. The biasing mechanism 60 includes a push bar 62 and a coil spring 59. The push bar 62 includes a shaft 62*a* which extends through a complementarily shaped aperture in the bottom of the first clamp 61*a*. An enlarged stop 62*b* is located at the terminal end of the shaft 62*a* external to the first clamp 61*a*. A generally cylindrical force applicator 62*c* is mounted on the end of the shaft 62*a* opposite the stop 62*b* and is sized to be complementary with the first clamp 61*a*. The spring 59 is disposed around the shaft 62*a* between the bottom of the first clamp 61*a* and the force applicator 62*c*. The stop 62*b* prevents the spring 59 from pushing the push bar 62 out of the first clamp 61*a*.

Referring now to FIGS. 2, 4 and 8, to mount the first rod 57*a* in the first and second clamps 61*a*, 61*b*, one end of the first rod 57*a* is applied against the force applicator 62*c* to compress the spring 59. This allows the other end of the first rod 57*a* to clear the inner facing surface of the second clamp 61*b*. The other end of the first rod 57*a* is then aligned with the second clamp 61*b* and the force of the spring 59 then guides the other end of the first rod 57*a* into the second clamp 61*b*. The first rod 57*a* is then releasably mounted in the first and second clamps 61*a*, 61*b*. To remove the first rod 57*a* from the first and second clamps 61*a*, 61*b*, the first rod 57*a* is pushed to compress the spring 59 until the end within the second clamp 61*b* clears the second clamp 61*b*. The first rod 57*a* is then moved out of alignment with the second clamp 61*b* and moved axially away from the first clamp 61*a* until it clears the first clamp 61*a*

The first and second clamps 61*a*, 61*b* are attached to the mounting bracket 101 by a suitable fastening method, such as welding, so that the sorter 51 is suspended below the drying rack 41. However, it is understood by those of ordinary skill in the art that the first and second clamps 61*a*, 61*b* could be mounted directly to the bottom surface 15 of the table 11, if the drying rack 41 were omitted. Regardless of where the first and second clamps 61*a*, 61*b* are attached (i.e. directly to the table or to the drying rack mount), other attachment methods could be used, such as glue, nails, and screws.

The ironing board of the present invention includes any of the three key features described above, namely, the offset frame 23, drying rack 41 or sorter 51, either as a single feature or combination of the features. That is, although FIGS. 1–10 show the ironing board 10 having in combination, the frame 23 positioned to be offset from the longitudinal axis 21 with the counterbalance extension section 31, the drying rack 41, and the laundry sorter 51, it is understood from this disclosure that the ironing board 10 of the present invention may be provided with a single of the three enumerated features or a combination of any of two of the features or a combination of all of the features. In addition, the ironing board 10 may also contain other important elements.

Referring now to FIGS. 2 and 3, a further feature of the ironing board includes a wire mesh rack 71 which is attached to the tracks 27 and is spaced from the bottom surface 15 of the table 11. The wire mesh rack 71 allows a sleeve board (not shown) to be placed thereon for the ironing of shirt sleeves in a manner well understood by those of ordinary skill in the art.

In operation and with respect to the ironing board 10 shown in FIG. 1, laundry to be washed is first sorted according to color or type of article to be washed into one or more of the three compartments 54 of the laundry sorter 51. When it is time to wash the articles within one of the compartments 54, the person doing the laundry may then either remove the first and second rods 57*a*, 57*b* with the receptacle 52 in tact, as described above, and then remove the articles from the compartments 54 at a position over the washer directly into the washing machine or simply removing the articles from the compartments 54 via the slit 55 in the face 54*a* and placing the articles into the washing machine. If the first and second rods 57*a*, 57*b* are detached from the receptacle 52, the first and second rods 57*a*, 57*b* should be repositioned within the first and second clamps 61*a*, 61*b* for future use and easy location. After the laundry is washed, the drying rack 41 may then be extended from the ironing board 10 to hang articles that are not to be dried in a dryer. The articles may be hung directly onto the rungs 45 of the drying rack 41 or put on hangers and the hangers then hung onto the drying rack 41. If the weight of the hung articles causes the ironing board 10 to be unbalanced, the counterbalance extension section 31 may be activated by extending the telescoping feet 35 outwardly and locking them in place to keep the ironing board 10 balanced in an upright position.

When it is time for one to do the ironing, the height of the ironing board 10 may be adjusted by turning the handle 97 of the adjustment mechanism 94 to allow the channel coupling mechanism 91 to slide along the tracks 27 to either raise or lower the table 11 to the desired height. For the person doing the ironing while sitting in a chair, the table 11 should be lowered to a position so that the person can sit in a chair comfortably with their lap and legs located under the table 11, as shown in FIG. 10. As mentioned above, because the frame 23 of the ironing board 10 is offset from the longitudinal axis 21 and located between a first side 17 and the longitudinal axis 21 an open area 103 is created for the person's legs that is unencumbered and uninhibited by the support structure. Once all laundering, drying, and ironing functions are complete, the drying rack 41 may be repositioned by sliding the drying rack 41 under the table 11 of the ironing board 10 and the ironing board 10 itself may be readjusted to its storage position. The sorter 51 may be retained on the ironing board 10 by the first and second rods 57*a*, 57*b*. The receptacle 52 may be folded for storage.

It will be appreciated by those skilled in the art that changes could be made to the embodiments described above without departing from the broad inventive concept thereof. It is understood, therefore that this invention is not limited to the particular embodiments disclosed, but it is intended to cover modifications within the spirit and scope of the present invention as defined by the appended claims.

What is claimed is:

1. An ironing board comprising:

a) a table having a top surface to carry out ironing functions thereon, said table having opposing first and second sides bisected by a longitudinal axis, b) a frame extending from the table for supporting said table, said frame extending from the table at said first side and defining an open area beneath said table, said open area being sized to receive a person seated in a chair to permit the person to carry out ironing functions on the top surface of the table while seated in the chair; and c) a laundry sorter suspended from the table, wherein the laundry sorter comprises a receptacle with a plurality of dividers within the receptacle which form a plurality of compartments.

2. The ironing board according to claim 1 wherein the frame is infinitely adjustable between a fully extended position and a storage position to allow a person to carry out ironing functions on the top surface of the table either standing or sitting in a chair.

3. The ironing board according to claim 1 further including a counterbalance extension section extending from the frame, said counterbalance extension section extending across said longitudinal axis and said second side of said table.

4. The ironing board according to claim 3 wherein the counterbalance extension section comprises at least one set of telescoping feet projecting from the frame and wherein one of the telescoping feet is extendible.

5. The ironing board according to claim 4 wherein the extendible feet include an enlarged knob located at a distal end thereof to tilt the top surface of the table with respect to the support surface.

6. The ironing board according to claim 1 further comprising a drying rack slidably disposed on said table, said drying rack including a plurality of rungs.

7. The ironing board according to claim 6 wherein the drying rack is slidably disposed between a stowed position under the table and a use position wherein the drying rack extends from the table in the form of a cantilever beam.

8. An ironing board comprising:

a) a table having a top surface to carry out ironing functions thereon;

b) a frame extending from the table for supporting said table above a support surface; and c) a single drying rack having a plurality of rungs, said drying rack being slidably disposed within a channel on said table.

9. The ironing board according to claim 8 wherein the drying rack comprises two side members, said plurality of rungs extending between the side members.

10. The ironing board according to claim 9 wherein two channels are mounted to the table, each of the side members of the drying rack being slidably disposed within one of the channels.

11. The ironing board according to claim 8 wherein the drying rack is slidably disposed between a stowed position under the table and a use position wherein the drying rack extends from the table in the form of a cantilever beam.

12. The ironing board according to claim 8 wherein the table has opposing first and second sides bisected by a longitudinal axis and the frame extends from the table between said first side and said longitudinal axis and defining an open area beneath said table, said open area being sized to receive a person seated in a chair to permit the person to carry out ironing functions on the top surface of the table while seated in the chair.

13. The ironing board according to claim 12 further including a counterbalance extension section extending from the frame, said counterbalance extension section extending across said longitudinal axis and said second side of said table.

14. The ironing board according to claim 13 wherein the counterbalance extension section comprises at least one set of telescoping feet projecting from the frame and wherein one of the telescoping feet is extendible.

15. The ironing board according to claim 14 wherein the extendible feet include an enlarged knob located at a distal end thereof to tilt the top surface of the table with respect to the support surface.

16. The ironing board according to claim 8 further comprising a laundry sorter suspended from a surface of the table wherein the laundry sorter comprises a receptacle with a plurality of dividers within the receptacle thereby forming a plurality of compartments.

17. An ironing board comprising:

a) a table having a top surface to carry out ironing functions thereon;

b) a frame extending from the table for supporting said table above a support surface; and c) a laundry sorter suspended directly beneath the table including a receptacle with a plurality of dividers dividing the receptacle into a plurality of compartments.

18. The ironing board according to claim 17 wherein each compartment has a front face with a slit in the face so that the compartment is accessible.

19. The ironing board according to claim 17 further comprising a rod from which the receptacle is hung, the rod being releasably mounted on the table.

20. The ironing board according to claim 17 wherein the table has opposing first and second sides bisected by a longitudinal axis and the frame extends from the table between said first side and said longitudinal axis and defining an open area beneath said table, said open area being sized to receive a person seated in a chair to permit the person to carry out ironing functions on the top surface of the table while seated in the chair.

21. The ironing board according to claim 20 further including a counterbalance extension section extending from the frame, said counterbalance extension section extending across said longitudinal axis and said second side of said table.

22. The ironing board according to claim 21 wherein the counterbalance extension section comprises at least one set of telescoping feet projecting from the frame and wherein one of the telescoping feet is extendible.

23. The ironing board according to claim 22 wherein the table includes a top surface and the extendible feet include an enlarged knob located at a distal end of to tilt the top surface of the table with respect to the support surface.

24. The ironing board according to claim 17 wherein the laundry sorter is constructed of fabric.

* * * * *